US012716237B2

(12) United States Patent
Sorkin

(10) Patent No.: US 12,716,237 B2
(45) Date of Patent: Aug. 25, 2026

(54) SPAN TO SPAN DUCT COUPLER

(71) Applicant: Felix Sorkin, Stafford, TX (US)

(72) Inventor: Felix Sorkin, Stafford, TX (US)

(73) Assignee: Felix Sorkin, Stafford, TX (US)

( * ) Notice: Subject to any disclaimer, the term of this patent is extended or adjusted under 35 U.S.C. 154(b) by 0 days.

(21) Appl. No.: 19/267,784

(22) Filed: Jul. 14, 2025

(65) Prior Publication Data

US 2025/0341095 A1 Nov. 6, 2025

Related U.S. Application Data

(62) Division of application No. 18/093,743, filed on Jan. 5, 2023, now Pat. No. 12,359,430.

(60) Provisional application No. 63/296,720, filed on Jan. 5, 2022.

(51) Int. Cl.
*E04C 5/10* (2006.01)

(52) U.S. Cl.
CPC ..... *E04C 5/10* (2013.01)

(58) Field of Classification Search
CPC ..... E04C 5/10
See application file for complete search history.

(56) References Cited

U.S. PATENT DOCUMENTS 3,666,296 A 5/1972 Fischetti
4,186,949 A 2/1980 Bartha et al.
6,764,105 B1 * 7/2004 Sorkin ..... F16L 25/0027 52/223.13
6,834,890 B2 * 12/2004 Sorkin ..... E04C 5/10 52/223.13
7,695,021 B1 * 4/2010 Sorkin ..... E04C 5/10 285/237
8,398,123 B1 * 3/2013 Sorkin ..... E04C 5/10 285/369
9,423,059 B1 * 8/2016 Sorkin ..... F16L 17/06
12,359,430 B2 * 7/2025 Sorkin ..... E04C 5/10
2004/0056483 A1 * 3/2004 Sorkin ..... F16L 25/0018 285/230

(Continued)

FOREIGN PATENT DOCUMENTS

KR 101 515 327 B1 4/2015

OTHER PUBLICATIONS

International Search Report and Written Opinion dated Apr. 26, 2023 received in PCT/US2023/10237 filed on Jan. 5, 2023.

(Continued)

*Primary Examiner* — Joshua K Ihezie
(74) *Attorney, Agent, or Firm* — Ervin Cohen & Jessup LLP

(57) ABSTRACT

A span to span duct coupler includes a coupler, a first end flange, and a second end flange. A first concrete element is formed to include a duct segment and the first end flange. The first end flange may be coupled to the first duct segment by a first duct boot. A second concrete element is formed to include a duct segment and a second end flange. The second end flange may be coupled to the second duct segment by a second duct boot. The coupler may include first and second coupler bodies and a coupler boot coupled to the first and second coupler bodies. The first coupler body may be mechanically coupled to the first end flange. The second coupler body may be coupled to the second end flange.

7 Claims, 3 Drawing Sheets

(56) References Cited

U.S. PATENT DOCUMENTS

| | | | | |
|---|---|---|---|---|
| 2006/0208480 | A1* | 9/2006 | Happel | B28B 23/0043 249/83 |
| 2011/0146049 | A1 | 6/2011 | Hagiya | |
| 2014/0367961 | A1* | 12/2014 | Crigler | F16L 13/113 285/230 |
| 2021/0324630 | A1 | 10/2021 | Sorkin | |
| 2025/0059764 | A1* | 2/2025 | Sorkin | E04C 1/39 |

OTHER PUBLICATIONS

European Extended Search Report dated Oct. 15, 2025 issued in European Application No. 23727597.7, 11 pages.

* cited by examiner

SPAN TO SPAN DUCT COUPLER

CROSS-REFERENCE TO RELATED APPLICATIONS

The present application is a divisional application which claims priority to Ser. No. 18/093,743, filed Jan. 5, 2025, which claims priority to U.S. Provisional Application No. 63/296,720 filed Jan. 5, 2022, each of which is incorporated by reference herein in its entirety.

TECHNICAL FIELD/FIELD OF THE DISCLOSURE

The present disclosure relates generally to a conduit coupling device. The present disclosure relates more specifically to a duct coupler assembly for providing a joint between adjacent sections of conduit.

BACKGROUND OF THE DISCLOSURE

Structural concrete, though capable of carrying very high compressive loads, is generally weak in carrying tensile loads on its own. Reinforced concrete ameliorates this deficiency by including an internal structure formed from materials capable of withstanding tensile forces within an otherwise solid concrete structure. Metal bars or cables are often used due to their high tensile strength and relative ease of manufacture.

In order to further improve the tensile capacities of reinforced concrete structures, the reinforcement structure may be pre- or post-tensioned. Added structural tension maintains a compression loading on the concrete member, even when tensile stress would otherwise occur, such as in beam-loading.

In post-tensioned concrete, the reinforcing structure is tensioned after the concrete has set. In one form of post-tensioned concrete, a series of conduits formed from duct segments are placed within the concrete form, each conduit positioned parallel to the desired tensile pre-loading. The conduits are threaded with the one or more tensile members, such as metal cables. After the concrete has set, the metal cables may then be placed under tension, and anchored to either end of the conduit, thus placing the concrete member under tensile loading.

Where a concrete member is to be poured adjacent to an existing concrete member, such as, for example, in a balanced cantilever construction bridge, the duct segments in the existing concrete member are traditionally coupled to ducts placed in the form of the new concrete member.

SUMMARY

The present disclosure provides for a duct coupler. The duct coupler may include a coupler, the coupler including first and second coupler bodies and a coupler boot. The coupler boot may be coupled to the first and second coupler bodies. The duct coupler may include a first end flange including a first end flange body. The duct coupler may include a second end flange including a second end flange body.

The present disclosure also provides for a system. The system may include a first concrete element having a duct segment and a first end flange formed therein. The first end flange may include a first end flange body. The first end flange may be coupled to the first duct segment by a first duct boot. The system may include a second concrete element having a duct segment and a second end flange formed therein. The second end flange may include a second end flange body. The second end flange may be coupled to the second duct segment by a second duct boot. The system may include a coupler. The coupler may include first and second coupler bodies and a coupler boot. The coupler boot may be coupled to the first and second coupler bodies. The first coupler body may be mechanically coupled to the first end flange. The second coupler body may be coupled to the second end flange.

The present disclosure also provides for a method. The method may include forming a first concrete element such that the first concrete element includes a duct segment and a first end flange formed therein. The first end flange may include a first end flange body. The first end flange may be coupled to the first duct segment by a first duct boot. The method may include forming a second concrete element such that the second concrete element includes a duct segment and a second end flange formed therein. The second end flange may include a second end flange body. The second end flange may be coupled to the second duct segment by a second duct boot. The method may include positioning the first and second concrete elements such that the first and second end flanges are substantially aligned and adjacent. The method may include positioning a coupler between the first and second end flanges the coupler including first and second coupler bodies and a coupler boot, the coupler boot coupled to the first and second coupler bodies. The method may include coupling the first coupler body to the first end flange. The method may include coupling the second coupler body to the second end flange.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
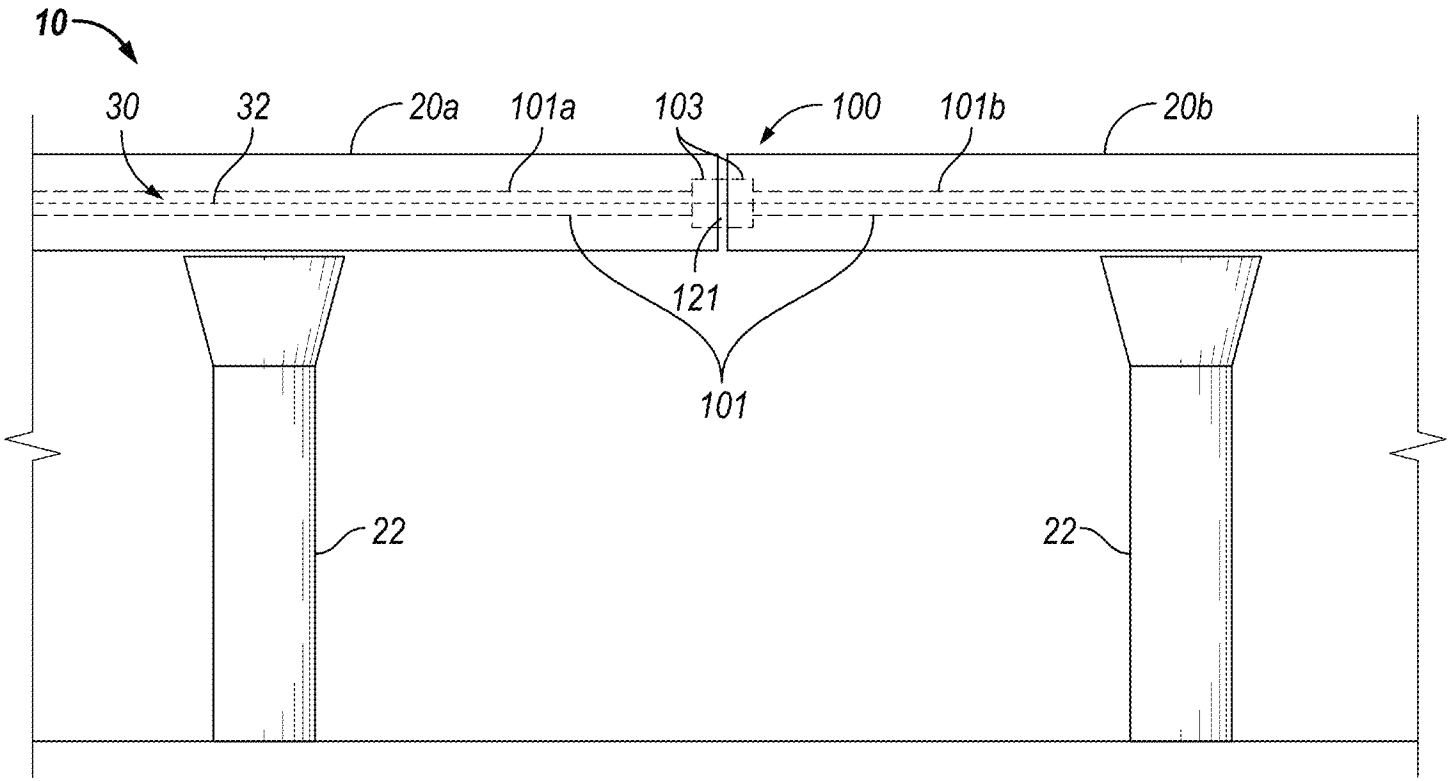
FIG. 1 is a side view of a concrete structure having ducts coupled with duct coupler assemblies consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts post-tensioned concrete structure 10 having first concrete element 20*a* and second concrete element

20*b*. Although depicted as bridge segments or spans, one having ordinary skill in the art with the benefit of this disclosure will understand that any concrete elements may be used as described herein without deviating from the scope of this disclosure. In some embodiments, first concrete element 20*a* may be poured before second concrete element 20*b*. In some embodiments, second concrete element 20*b* may be poured in a form (not shown) such that second concrete element 20*b* is adjacent to first concrete element 20*a*. In other embodiments, first concrete element 20*a* and second concrete element 20*b* may be formed separately and positioned end-to-end to form a bridge.

In some embodiments, one or more duct segments 101 for post tensioning concrete structure 10 may be positioned within concrete elements 20*a* and 20*b*. In some embodiments, first duct segment 101*a* may be positioned in first concrete element 20*a* and second duct segment 101*b* may be positioned in second concrete element 20*b*. In some embodiments, duct segments 101 may be formed integrally within concrete elements 20*a* and 20*b* of concrete structure 10 by pouring concrete around duct segments 101*a* and 101*b*, respectively. In some embodiments, conduit 30 may be formed as a continuous tube made up of duct segments 101, such as duct segments 101*a* and 101*b*, which are coupled together by duct coupler assemblies 100 at the interfaces between adjacent concrete elements, such as concrete elements 20*a* and 20*b*. Duct coupler assembly 100 may, for example, structurally connect first duct segment 101*a* and second duct segment 101*b* as well as form a seal to restrict concrete and other fluids from entering the interior of conduit 30. Duct segments 101 may be piping, duct, or any other appropriate material for use in post-tension concrete.

At least one tensioning member such as, for example, metal cable 32 may be threaded through conduit 30. Metal cable 32 may later be placed under tension after the concrete has been poured. An anchor may be affixed to each end of metal cable 32 to hold it under tension.

Figure 2:
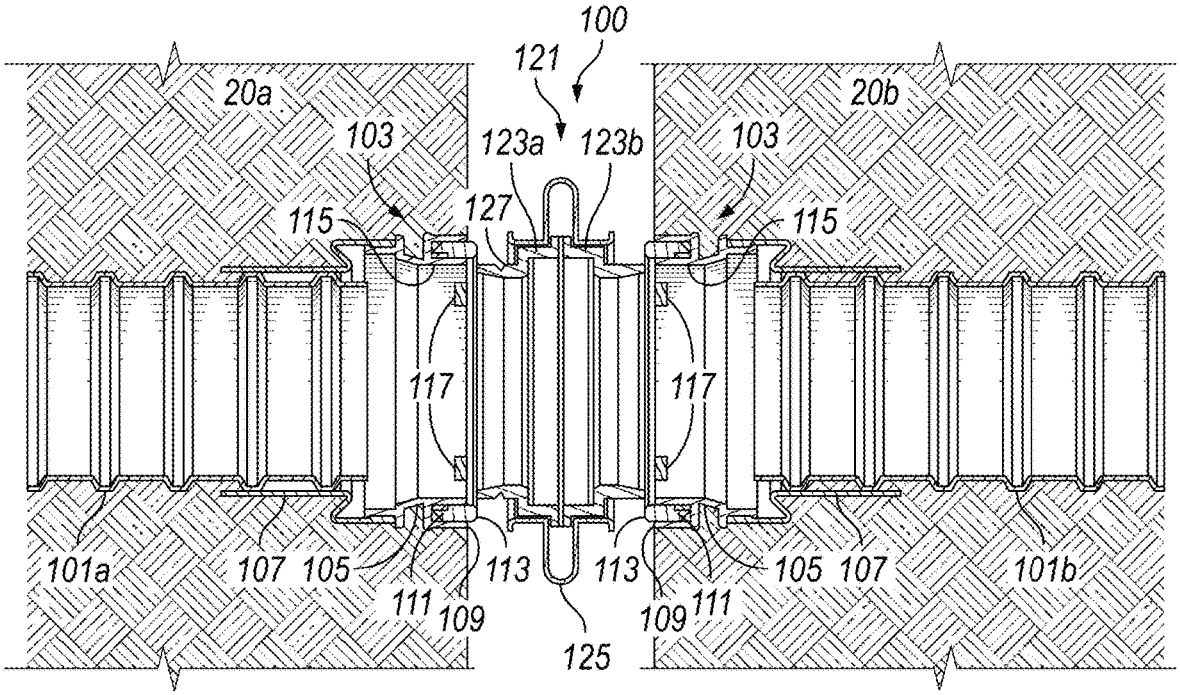
FIG. 2 is a cross section view of a duct coupler assembly consistent with at least one embodiment of the present disclosure.

FIG. 2 depicts duct coupler assembly 100 in an unsecured position. Duct coupler assembly 100 may include end flanges 103 and coupler 121. In some embodiments, duct coupler assembly 100 may include an end flange 103 for each of concrete elements 20*a*, 20*b* such that duct segments 101 may be coupled therebetween. For example, a first end flange 103 may be coupled to first duct segment 101*a* and may be cast in place along with first duct segment 101*a* in first concrete element 20*a*, and a second end flange 103 may be coupled to second duct segment 101*b* and may be cast in place along with second duct segment 101*b* in second concrete element 20*b*. Coupler 121 may be used to join to end flanges 103, thereby coupling duct segments 101.

In some embodiments, each end flange 103 may include end flange body 105. End flange body 105 may be annular or tubular and may define an interior through which metal cable 32 may pass. In some embodiments, end flange 103 may include duct boot 107. Duct boot 107 may be mechanically coupled to end flange body 105 and may be positioned such that duct boot 107 extends along at least part of the outer surface of the duct segment 101 to which end flange 103 is coupled. Duct boot 107 may serve to couple end flange 103 to duct segment 101, and may serve to reduce or prevent ingress of concrete into the interior of duct coupler assembly 100 or duct segment 101 during the concrete pouring process.

In some embodiments, end flange body 105 may include end face 109. End face 109 may be positioned at or substantially at the end of concrete element 20*a* or 20*b* into which end flange 103 is positioned. In some embodiments, end face 109 may include seal groove 111 formed therein. In some such embodiments, seal element 113 may be positioned within seal groove 111 and may be used to seal against coupler 121 as further discussed below.

In some embodiments, inner surface 115 of end flange body 105 may include one or more retention features 117 such as, for example and without limitation, one or more teeth, dogs, threads, protrusions, detents, grooves, slots, or other features used to engage elements of coupler 121 as further described below.

In some embodiments, coupler 121 may include first and second coupler bodies 123*a*, 123*b* and coupler boot 125. Coupler boot 125 may be formed from a flexible material such as an elastomer. Coupler boot 125 may couple between first and second coupler bodies 123*a*, 123*b*.

In some embodiments, each of coupler bodies 123*a*, 123*b* may be adapted to couple to a respective end flange body 105 of an end flange 103 formed into a corresponding concrete element 20*a*, 20*b*. Coupler bodies 123*a*, 123*b* may include one or more retention features 127 such as, for example and without limitation, one or more teeth, dogs, threads, protrusions, detents, grooves, slots, or other features used to engage with retention features 117 of end flange body 105 such that coupler bodies 123*a*, 123*b* may each mechanically couple to the respective end flange 103 when duct coupler assembly 100 is used.

In some embodiments, in order to couple duct segments 101*a*, 101*b* of concrete elements 20*a*, 20*b*, concrete elements 20*a*, 20*b* may first be formed such that each includes a respective duct segment 101*a*, 101*b* and an end flange 103 of duct coupler assembly 100. In some embodiments, concrete elements 20*a*, 20*b* may be moved into position or may be formed in situ such that concrete elements 20*a*, 20*b* are substantially adjacent with end flanges 103 proximate and aligned. For example, where concrete elements 20*a*, 20*b* are spans of a bridge as shown in FIG. 1, concrete elements 20*a*, 20*b* may be positioned atop piers 22 or formed in situ atop piers 22 (such as in a balanced cantilever construction bridge) such that end flanges 103 are aligned.

Figure 3:
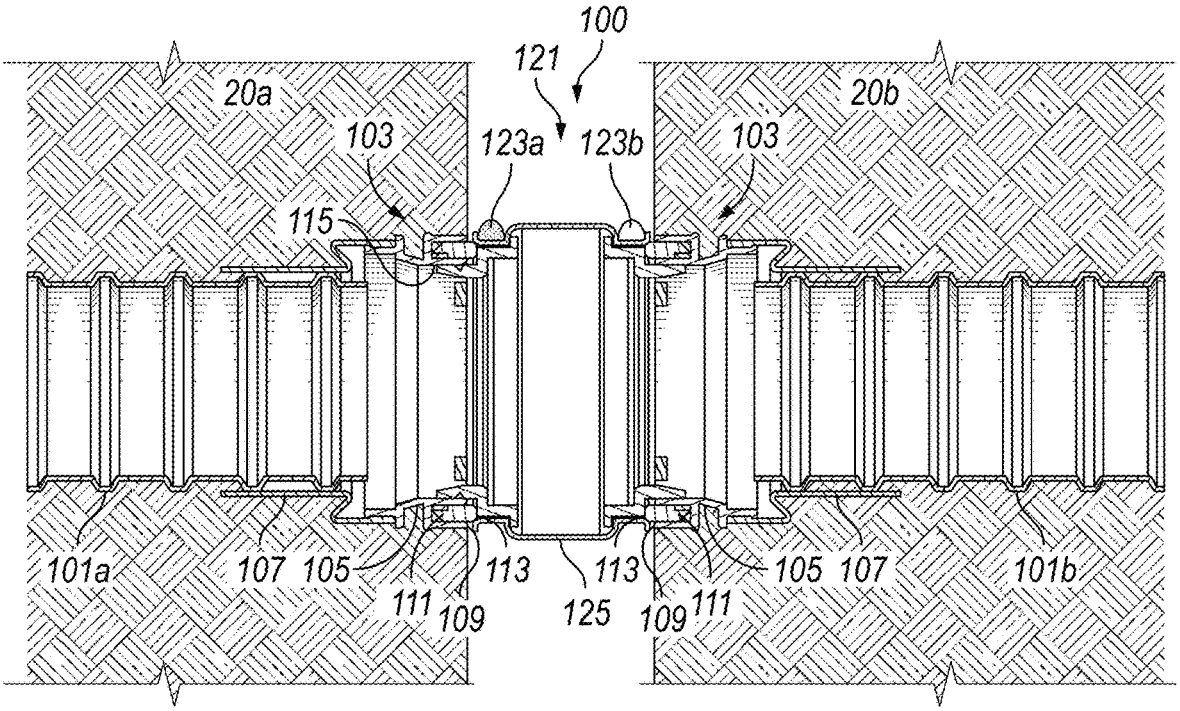
FIG. 3 is a cross section view of the duct coupler assembly of FIG. 2 in an installed configuration.

Coupler 121 may then be moved into position between end flanges 103 as shown in FIG. 2. Each of coupler bodies 123*a*, 123*b* may then be coupled to a respective end flange 103 as shown in FIG. 3. In some such embodiments, retention features 127 of coupler bodies 123*a*, 123*b* may be engaged to retention features 117 of end flanges 103 such that coupler bodies 123*a*, 123*b* are mechanically coupled to respective end flanges 103.

In some embodiments, as coupler bodies 123*a*, 123*b* are coupled to end flanges 103, coupler bodies 123*a*, 123*b* may be moved longitudinally apart from each other. Coupler boot 125 may expand longitudinally such as, for example and without limitation, by elastic flexure and remain mechanically coupled to coupler bodies 123*a*, 123*b* as coupler bodies 123*a*, 123*b* are coupled to end flanges 103 and due to any relative movement between concrete elements 20*a*, 20*b* during operation of the structure of which concrete elements 20*a*, 20*b* are a part. Coupler boot 125 may therefore reduce or prevent fluids, debris, or other materials or contaminants from entering the interior of duct coupler assembly 100 and duct segments 101*a*, 101*b*.

Figure 4:
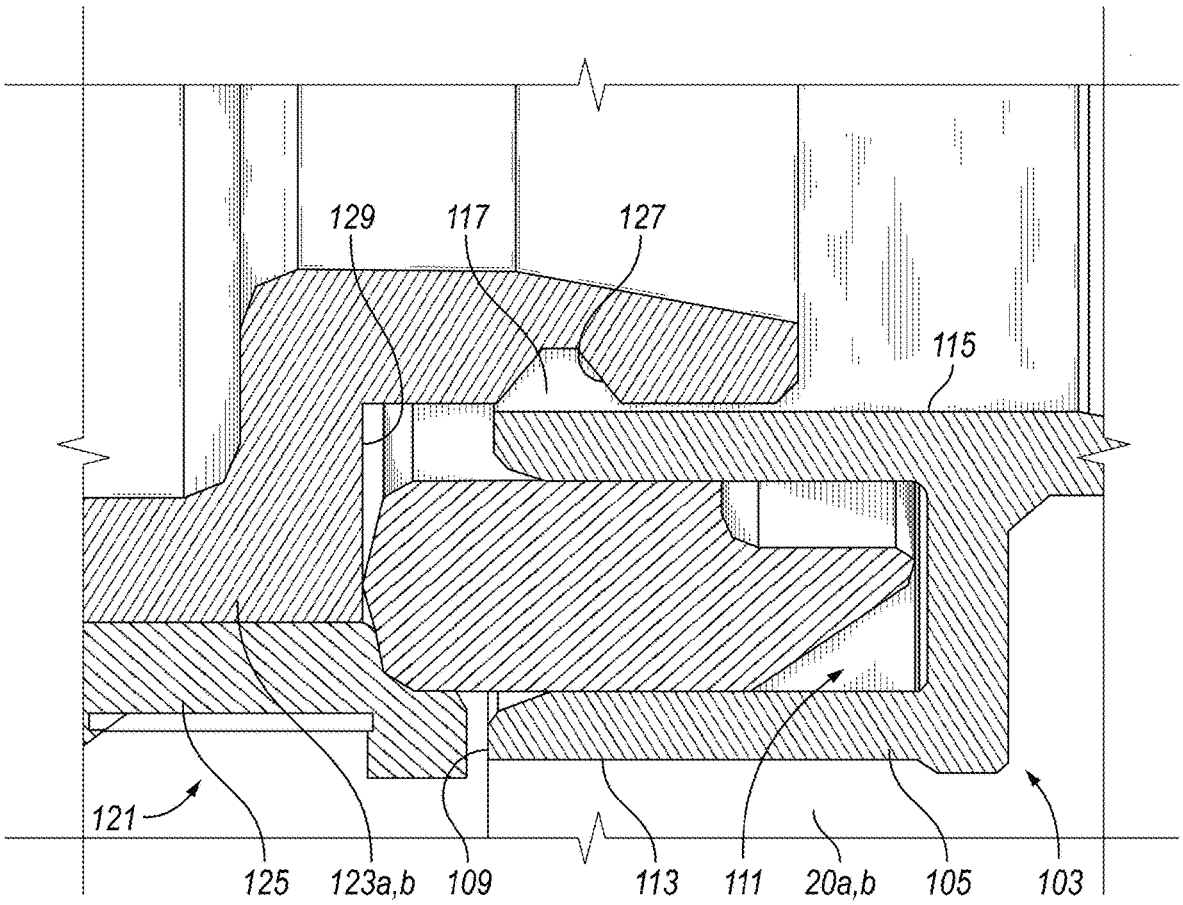
FIG. 4 is a detail cross section view of the duct coupler assembly of FIG. 3.

In some embodiments, as coupler bodies 123*a*, 123*b* are mechanically coupled to end flanges 103, coupler bodies 123*a*, 123*b* may engage against seal element 113 as shown in FIG. 4. In such an embodiment, coupler bodies 123*a*, 123*b* may include seal face 129 positioned to engage with an end of seal element 113. In some embodiments, seal element 113 may engage against coupler boot 125.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A method comprising:

forming a first concrete element such that the first concrete element includes a duct segment and a first end flange formed therein, the first end flange including a first end flange body, the first end flange coupled to the first duct segment by a first duct boot;

forming a second concrete element such that the second concrete element includes a duct segment and a second end flange formed therein, the second end flange including a second end flange body, the second end flange coupled to the second duct segment by a second duct boot;

positioning the first and second concrete elements such that the first and second end flanges are substantially aligned and adjacent;

positioning a coupler between the first and second end flanges, the coupler including first and second coupler bodies and a coupler boot, the coupler boot coupled to the first and second coupler bodies;

coupling the first coupler body to the first end flange; and coupling the second coupler body to the second end flange;

wherein each of the first and second end flange bodies comprises an end face, the end face having a seal groove formed therein.

2. The method of claim 1, wherein a seal element is positioned within the seal groove.

3. The method of claim 1, wherein the first end flange body includes one or more retention features adapted to engage with one or more retention features positioned on the first coupler body.

4. The method of claim 1, wherein the coupler boot is formed from an elastomeric material.

5. The method of claim 1, wherein the second end flange body includes one or more retention features adapted to engage with one or more retention features positioned on the second coupler body.

6. A method comprising:

forming a first concrete element such that the first concrete element includes a duct segment and a first end flange formed therein, the first end flange including a first end flange body, the first end flange coupled to the first duct segment by a first duct boot;

forming a second concrete element such that the second concrete element includes a duct segment and a second end flange formed therein, the second end flange including a second end flange body, the second end flange coupled to the second duct segment by a second duct boot;

positioning the first and second concrete elements such that the first and second end flanges are substantially aligned and adjacent;

positioning a coupler between the first and second end flanges the coupler including first and second coupler bodies and a coupler boot, the coupler boot coupled to the first and second coupler bodies;

coupling the first coupler body to the first end flange; and coupling the second coupler body to the second end flange;

wherein the first end flange body includes one or more retention features adapted to engage with one or more retention features positioned on the first coupler body; and wherein the second end flange body includes one or more retention features adapted to engage with one or more retention features positioned on the second coupler body;

wherein each of the first and second end flange bodies comprises an end face, the end face having a seal groove formed therein.

7. The method of claim 6, wherein a seal element is positioned within the seal groove.

* * * * *